United States Patent [19]

Stevens

[11] Patent Number: 4,652,050

[45] Date of Patent: Mar. 24, 1987

[54] CHAIR TILT MECHANISM

[75] Inventor: Charles J. Stevens, Jenison, Mich.

[73] Assignee: Herman Miller, Inc., Zeeland, Mich.

[21] Appl. No.: 570,076

[22] Filed: Jan. 11, 1984

[51] Int. Cl.[4] ..... A47C 3/00

[52] U.S. Cl. ..... 297/300; 297/304; 297/316

[58] Field of Search ..... 297/300, 301, 304, 305, 297/316, 322

[56] References Cited

U.S. PATENT DOCUMENTS

| | | | |
|---|---|---|---|
| 2,028,633 | 1/1936 | Thomas . | |
| 2,341,124 | 2/1944 | Sheldrick | 297/301 |
| 2,374,350 | 4/1945 | Herold | 297/301 |
| 2,463,257 | 3/1949 | Fox | 297/305 |
| 2,516,801 | 7/1950 | Renaud | 297/150 X |
| 2,619,153 | 11/1952 | Van Osselen . | |
| 2,650,646 | 9/1953 | Herold et al. | 297/301 |
| 2,859,799 | 11/1958 | Moore | 297/316 X |
| 2,859,801 | 11/1958 | Moore . | |
| 3,037,735 | 6/1962 | Matthews . | |
| 3,333,811 | 8/1967 | Matthews | 297/300 |
| 3,390,857 | 7/1968 | Nystrom . | |
| 3,453,024 | 7/1969 | Williams | 297/304 |
| 3,741,607 | 6/1973 | Cramer . | |
| 3,995,797 | 12/1976 | Knight . | |
| 4,209,158 | 6/1980 | Pickles . | |
| 4,429,917 | 2/1984 | Diffrient . | |
| 4,479,679 | 10/1984 | Fries et al. | 297/300 |
| 4,494,794 | 1/1985 | Barley | 297/307 |

FOREIGN PATENT DOCUMENTS

| | | | |
|---|---|---|---|
| 1203783 | 9/1970 | United Kingdom | 297/304 |

*Primary Examiner*—Francis K. Zugel

*Attorney, Agent, or Firm*—Varnum, Riddering, Schmidt & Howlett

[57] ABSTRACT

A chair tilt mechanism (100) includes a support casting (110) mounted to a chair spindle (104) and a seat casting (130) having a chair seat (102) mounted thereon. A pair of elongated forward links (150) and a pair of triangular shaped rear links (160) are pivotably connected to both the seat casting (130) and support casting (110). A slidably mounted spring yoke (210) includes a front vertical portion (212) interconnected between rearwardly extending arms (214) which are pivotably connected to the rear links (160). As the seat casting (130) is tilted, the links (160) pivot away from an initially biased position and the spring yoke (210) compresses a coiled outer spring (200). A concentric coiled inner spring (202) is provided to increase the spring rate in the event that the outer spring (200) is compressed a certain degree. In a second embodiment, the springs are compressed by the movement of the front links rather than the rear links.

20 Claims, 11 Drawing Figures

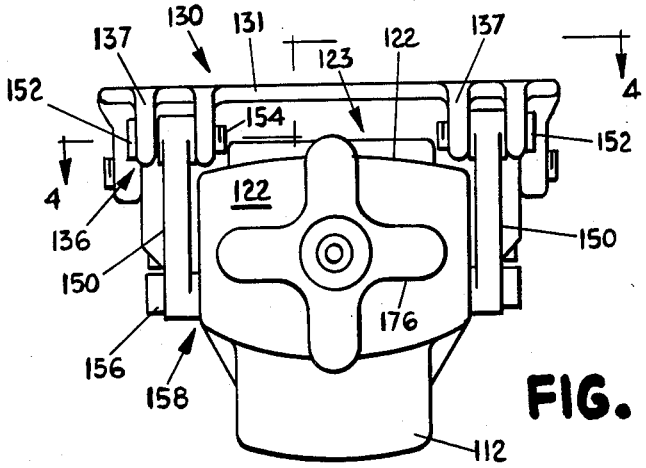
FIG. 3
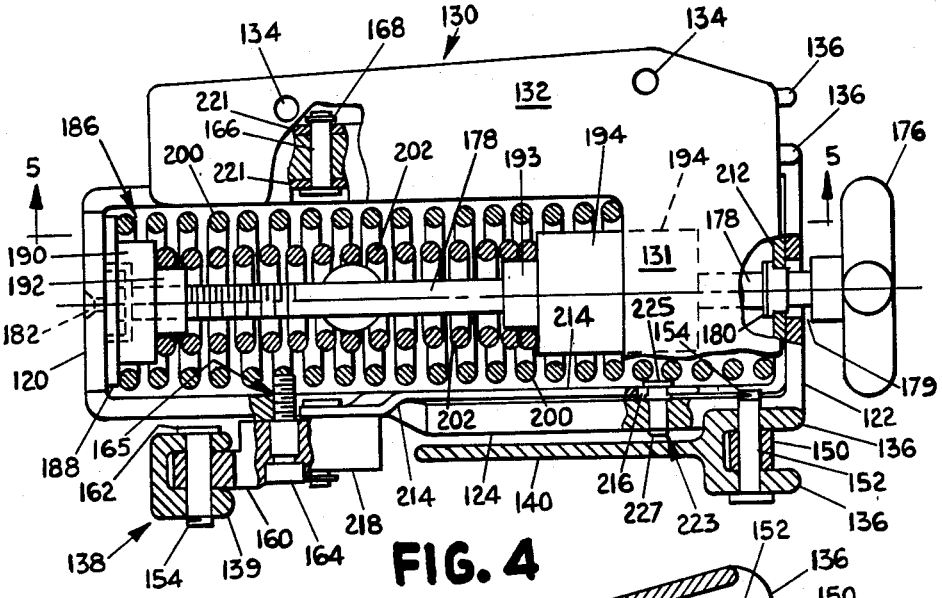
FIG. 4
FIG. 5

CHAIR TILT MECHANISM

DESCRIPTION

1. Technical Field

This invention relates to seat adjustment devices and, more particularly, to tilt mechanisms for chairs.

2. Background Art

Seating articles, such as chairs, often include mechanisms to provide position adjustment of various parts of the chairs. These adjustments can include, for example, modification of the elevation of a chair seat relative to ground level and modification of horizontal locations of both a chair seat and back support relative to an initial position.

In addition, modern chair assemblies, particularly those adapted for use in office environments, can include mechanisms for providing a reclining or "tilting" function to the chairs. These tilt mechanisms are constructed so as to provide the tilting function in response to forces applied by movement of the chair occupant.

One example of this type of chair tilt mechanism is described in the U.S. Pat. No. 2,859,801, to Moore issued Nov. 11, 1958. The Moore patent describes a tiltable chair in which a four-bar linkage is utilized to mount a chair seat and chair back support to a spindle. The linkage includes two pairs of levers, each pivotably connected at lower ends to opposing ends of a stationary base member mounted to the spindle. The levers are also pivotably connected to a frame member secured to the chair seat and to an upper pair of links which are secured to the back support. When a chair occupant applies a rearward pushing force against the back support, the levers rotate in a manner so as to cause a tilting motion of the chair seat.

As evident from the Moore patent, the employment of four-bar linkages to chair tilt devices is known in the prior art. However, these known adaptations do not appear to provide rotational tilting movement which is optimally the most comfortable and natural to the occupant. As commonly known to those skilled in the geometric considerations of four-bar linkage design, the effective axis of rotation is typically defined as the intersecting line between planes bisecting and perpendicular to the arcs traversed by pivoting links or levers of the four-bar linkage. To obtain optimal comfort and natural tilting movement, this axis of rotation should preferably be located near the occupant's ankle position.

Another aspect of chair tilt mechanisms relates to arrangements for providing biasing or opposing forces when a chair occupant moves so as to tilt the chair. In addition, the tilt mechanisms preferably include means for maintaining a chair in an initially biased position absent externally applied tilting forces. If the foregoing is not provided, the chair will tend to immediately move to its fully tilted position and will not return to an upright position when the tilting force is removed. It is also preferable to utilize a biasing device which requires a continuous increase of applied forces to tilt the chair greater distances away from the initial position. Furthermore, since individuals vary greatly in size and weight, it is advantageous to utilize a resistance device whereby the tension of the device can be manually adjusted so as to modify the amount of applied force necessary to tilt the chair a particular distance away from this position.

A common device used in chair tilt mechanisms to achieve the aforedescribed characteristics is a spring arrangement with means for manually adjusting the tension of the spring. Adjustable spring arrangements are disclosed in the Moore patent and in the Van Osselen U.S. Pat. No. 2,619,153, issued Nov. 25, 1952. However, the known arrangements generally employ only a single spring and are not particularly suited for providing a comfortable force opposing tilting movement for chair occupants having a wide range of sizes and weights in a mechanism in which the tilt axis is spaced from the center line of the chair support. As the pivot axis becomes farther spaced from the chair support centerline, the force differential between light and heavy people becomes more pronounced and a single spring becomes less effective. A non-linear spring should be provided to compensate for heavier and lighter people in chair tilt mechanisms of this type.

DISCLOSURE OF THE INVENTION

In accordance with the invention, a chair tilt mechanism for use with a chair is adapted to allow an occupant to tilt the chair seat through a continuum of tilted positions while maintaining the pivot axis of tilting rotation below the mechanism and near the location of the occupant's ankles. The mechanism includes lower support means adapted to be mounted to a chair base and seat support means for mounting a chair seat. The mechanism also includes foward linkage means pivotably connected at one end to a forward portion of the seat support means and at another end to the lower support means. Correspondingly, rear linkage means located rearward of the forward linkage means are pivotably connected at one end to a rear portion of the seat support means and at another end to the lower support means. In accordance with the invention, the spacing between the forward and rear linkage means and the size of the forward and rear linkage means are so shaped so as to tilt the chair seat about a pivot axis of rotation near the ankle position of a chair occupant.

The tilt mechanism also includes biasing means mounted to the lower support means for biasing the seat support means to a forward position with respect to the lower support means. The biasing means has a first force rate when the seat support means tilts through a first angle relative to the lower support means and a second force rate when the seat support means moves through a second angle subsequent to the first angle. The tilt mechanism also comprises means for adjusting the extent of the first angle so as to adjust the degree of tilt before the second force rate is effective.

The biasing means includes first compressible means mounted to the lower support means for generating a biasing force at the first force rate while the seat support means tilts through the first angle. Second compressible means are also mounted to the lower support means and generate a portion of the biasing force at the second force rate while the seat support means moves through the second angle. Translation means are pivotably connected to the rear or forward linkage means and compress the first compressible means during movement of the seat support means away from the forward biased position. The translation means also compresses the second compressible means during movement of the seat support means through the second angle. In some cases, the second compressible means may not be compressed unless the first compressible means is compressed initially by the adjusting means.

The chair tilt mechanism also includes means for slidably mounting the translation means within the lower support means so as to allow the translation means to slide rearwardly in response to movement of the rear or forward linkage means away from the forward biased position. This rearward movement compresses the first and second compressible means. In one embodiment, the translation means includes a yoke having rearwardly extending arms pivotably connected to the rear linkage means. A forward vertical portion is connected between the rearwardly extending arms and mounted to the means for slidably mounting the translation means. In another embodiment, the translation means is mounted to the forward linkage means.

In one embodiment of the invention, the means for slidably mounting the translation means includes a shaft axially extending through the lower support means. The first compressible means is mounted longitudinally along the shaft and abuts a rear face of the forward vertical portion of the yoke.

The first compressible means can include a coiled outer spring mounted axially along the shaft and having a foward end abutting a rear face of the forward vertical portion of the yoke. Rearward movement of the vertical front portion of the yoke thus compresses the coiled outer spring, thereby generating at least in part the first force rate. The second compressible means is also mounted axially along the shaft and spaced a predetermined longitudinal distance from the forward vertical portion of the yoke when the seat support means is in the forward biased position. The vertical front portion of the yoke initially contacts the second compressible means when the seat support means attains the extent of the first angle.

The second compressible means can include a coiled inner spring and a spring extender, each mounted coaxially along the shaft. In accordance therewith, movement of the seat support means through the second angle causes the forward vertical portion of the yoke to compress the coiled inner spring.

The means for adjusting the extent of the first angle include compressing means in contact with a rear end of the first compressible means for compressing the first compressible means. Means for mounting the compressing means allow the compressing means to move forwardly in response to manual adjustment of the adjustment means. This forward movement compresses the first compressible means. The compressing means is also in contact with a rear end of the second compressible means and forward movement of the compressing means decreases the distance between the second compressible means and the forward end of the first compressible means.

The means for mounting the compressing means includes a thread on a terminating end of a shaft axially extending through the outer spring. The compressing means abuts the rear end of the coiled spring and is threadably received on the shaft. Rotation of the shaft in one direction causes compression of the spring by maintaining the forward end of the spring in a stationary position while moving forward the rear end of the spring.

In accordance with one embodiment of the invention, the rear linkage means includes a pair of parallel, triangularly shaped rear links mounted on opposing lateral sides of the seat support means. The forward linkage means includes a pair of parallel elongated forward links also mounted on opposing lateral sides of the seat support means. A coiled spring is mounted longitudinally to the lower support means and a spring yoke is slidably mounted to the mechanism support means and includes a forward vertical portion abutting a forward end of the coiled spring. The yoke also comprises a pair of parallel arms extending rearwardly from the forward vertical portion, with each arm pivotably connected to one of the rear links. Rotation of the rear links away from the forward biased position causes the forward vertical portion of the spring yoke to slide rearwardly, thereby compressing the coiled spring.

BRIEF DESCRIPTION OF THE DRAWINGS

A preferred embodiment of the invention will now be described with reference to the drawings in which:

FIG. 3 is a front elevational view of the chair tilt mechanism seen along lines 3—3 of FIG. 2;

FIG. 4 is a sectional view of the chair tilt mechanism taken along lines 4—4 of FIG. 3;

FIG. 5 is a side sectional view of the chair tilt mechanism taken along lines 5—5 of FIG. 4;

BEST MODE FOR CARRYING OUT THE INVENTION

Figure 1:
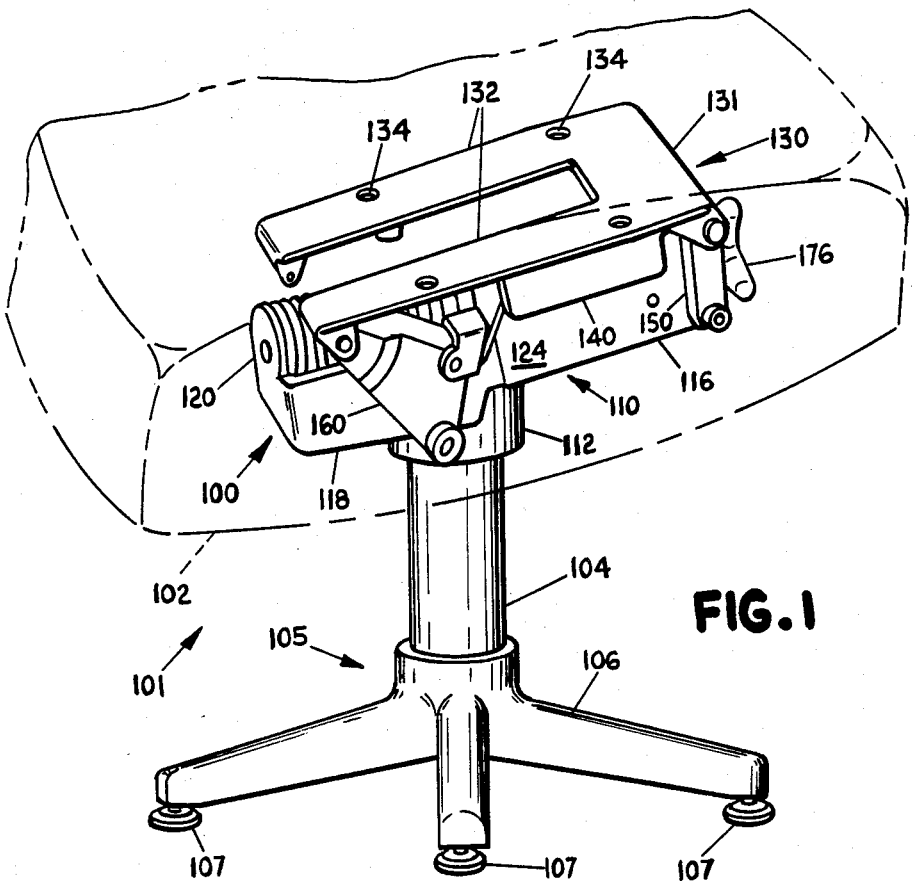
FIG. 1 is a perspective view of a chair tilt mechanism in accordance with the invention, with the mechanism depicted as attached to a conventional chair seat and spindle.

The principles of the invention are disclosed, by way of example, in a chair tilt mechanism 100 depicted in FIG. 1. The tilt mechanism 100 can be utilized with various types of chair assemblies, such as the assembly 101 also partially depicted in FIG. 1. The chair assembly 101 includes a conventional chair seat 102 mounted above a seat casting 130 by means such as nut and bolt arrangements whereby the bolts are secured through bores 134 in the seat casting 130. As depicted in FIG. 1, the front of the chair assembly 101 is to the right and the rear is toward the left. The chair assembly 101 can have various types of back supports, arm rests and other conventional and well-known chair components. These components do not form the basis for any of the novel concepts of a chair tilt mechanism in accordance with the invention, and, accordingly, are not depicted in the drawings.

Figure 2:
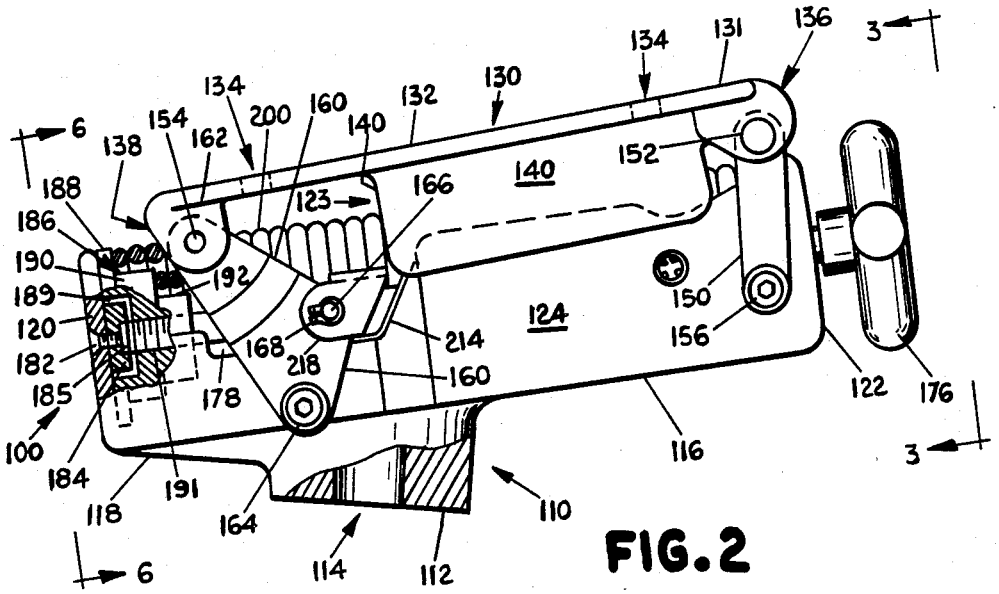
FIG. 2 is a side elevational view of the chair tilt mechanism depicted in FIG. 1.

As also depicted in FIG. 1, the chair tilt mechanism 100 includes a lower support casting 110 having a downwardly depending cylindrical spindle housing 112. As shown in FIG. 2, the housing 112 includes a central spindle bore 114 which can be threaded or otherwise include other conventional connecting means so as to receive a vertically disposed chair spindle 104 as depicted in FIG. 1. The chair spindle 104 is conventionally secured at its lower end to a chair base 105 which can comprise any one of various and well-known chair-supporting arrangements. For example, as depicted in FIG. 1, the chair base 105 can include several horizontally extending support legs 106 having floor supports 107 mounted to the distal portions thereof.

The detailed structure of the chair tilt mechanism 100 will now be described with reference to FIGS. 2–6. The support casting 110 is an integral casting which includes a slightly curved forward lower portion 116 and a slightly curved rear lower portion 118, each portion being integral with the spindle housing 112, which is positioned slightly rearward from the center of casting 110. Integrally connected to the forward lower portion 116 at the front thereof is a substantially vertical front portion 122 having a centrally located opening 179. Similarly, a rear vertical portion 120 is integrally connected to the rear lower portion 118. The casting 110 also includes a pair of upwardly extending side portions 124 integrally connected to the lateral sides of the forward lower portion 116 and rear lower portion 118. The aforedescribed components of casting 110 are configured so as to form a substantially tubular shaped shell 123, open at its top area. The support casting 110 thereby provides a means for securing the chair tilt mechanism 100 to the chair-supporting structure comprising the spindle 104 and chair base 105, and further provides a means for mounting various other components of the chair tilt mechanism 100 as subsequently described herein.

As previously described, the chair tilt mechanism 100 includes a substantially horizontally disposed seat casting 130 having a forward cross portion 131 and a pair of parallel chair seat connecting brackets 132 integrally connected thereto and extending rearwardly from and in the same general plane as cross portion 131. The general shape and configuration of the seat casting 130 is depicted in FIG. 1. Also as previously described, the seat casting 130 includes vertically disposed bores 134 (four are depicted in FIG. 1) which can be utilized with conventional connecting means to secure the tilt mechanism 100 to a chair seat such as seat 102 previously described.

Integrally connected to the forward portion 131 and chair seat connecting brackets 132, and depending downwardly therefrom on each side of the adjustment mechanism 100, are a pair of side mountings 140, each side mounting having a forward upper hinge bracket 136. Each of the forward upper hinge brackets 136 is utilized to secure in a pivotable manner one of a pair of elongated forward links 150 which comprise a forward linkage means of tilt mechanism 100. As shown in FIGS. 3 and 4, the hinge brackets 136 each include a pair of parallel downwardly-depending flanges 137 having bores therethrough which receive an upper forward link pin 152. Link pin 152 is additionally received through a bore in the upper end of the forward link 150 so as to pivotably mount the link 150 intermediate the flanges 137. A retainer ring 154 is utilized to secure the link pin 152 within the bores of flanges 137. The mounting of links 150 to each of the upper hinge brackets 136 allows links 150 to freely rotate relative to an associated bracket, absent other mechanisms subsequently described herein which tend to maintain the position of links 150 relative to brackets 136 in a forward biased position depicted in FIG. 2.

The lower portion of each of the forward links 150 is pivotably secured to the forward area of one of the side portions 124 of support casting 110. The lower portion of each of the forward links 150 includes a smooth lateral bore concentrically positioned relative to threaded bore 158. As depicted in FIGS. 2 and 3, conventional shoulder screw 156 is journalled into the smooth bore of each of links 150 so that the shoulder portion of screw 156 snugly mounts the link 150 but allows rotation thereof. The shoulder screws 156 are also threadably received in associated bores 158 and thereby provide a stationary transverse pivot axis for each of the links 150.

Figure 6:
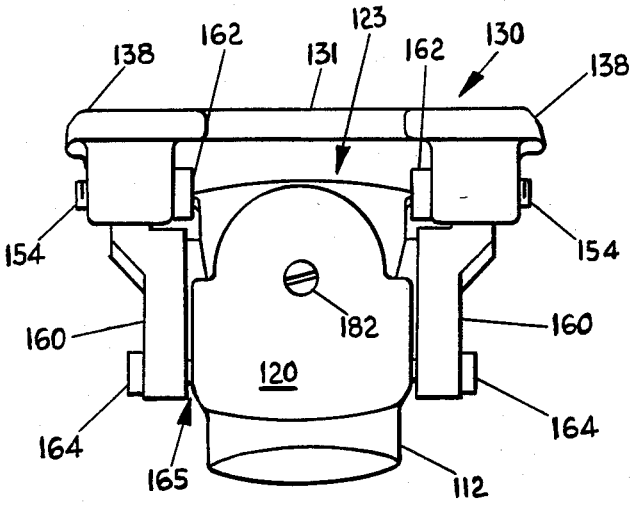
FIG. 6 is a rear elevational view of the chair tilt mechanism seen along lines 6—6 of FIG. 2.

The previously described arrangement of the forward link pins 150 comprises two linkages which form a forward linkage means of a four-bar linkage mechanism of chair tilt mechanism 100. Turning to the remaining linkages, the tilt mechanism 100 includes a pair of rear upper hinge brackets 138 integral with and depending downwardly from the chair connecting brackets 132 at the rear areas thereof as shown in FIGS. 2, 4 and 6. Each of the brackets 138 is utilized to secure in a pivotable manner one of a pair of rear links 160 comprising a rear linkage means of mechanism 100. As depicted in FIG. 2, the configuration of each of the rear links 160 is triangular in nature. The hinge brackets 138 each include a pair of parallel flanges 139 having smooth bores laterally therethrough which receive an upper rear link pin 162 similar to pin 152, and which pivotably secures the associated link 160 to the bracket 138. The pin 162 is further received through a smooth bore in the upper portion of link 160 so as to mount the pin 160 intermediate the bracket flanges 139. A retainer ring 154 is utilized to secure the link pin 162 within the bores of flanges 139. The pivotable mounting of rear links 160 to brackets 138 is substantially identical to the mounting of forward links 150 to brackets 136. In a like manner to the forward links 150, each of the rear links 160 would be free to rotate within its mounting to a corresponding bracket 138 absent other mechanisms subsequently described herein which tend to maintain the relative position of brackets 138 and rear links 160 in the forward biased position depicted in FIG. 2.

In a manner similar to the previously described pivotable connections of the lower portions of forward links 150, the lower portion of each of the rear links 160 is pivotably secured to one of opposing sides 124 of support casting 110 by means of a conventional shoulder screw 164, similar to the previously described shoulder screw 156 utilized with links 150 but somewhat larger in size to accomodate the larger links 160. As depicted in detail in a cut-away view of FIG. 4, each shoulder screw 164 is journalled into a smooth bore of an associated link 160 so that its shoulder portion snugly mounts the link 160 but allows free rotation thereof. Each screw 164 is threaded at its end and received in a threaded bore 165 through the side portion 124 of support casting 110. The mounting of each link 160 to a corresponding shoulder screw 164 provides a stationary transverse pivot axis for the links 160.

The lower curved portions 116, 118, rear and front vertical portions 120 and 122, respectively, and the side portions 124 of support casting 110 form a curved and partially enclosed shell 123 extending linearly through the tilt mechanism 100. Connected to the front surface of rear vertical portion 120 is a locator device 184 shown in a partially cut-away section in FIG. 2. The locator 184 is of a circular cross-section with a rear threaded bore centrally located and corresponding in diameter to a bore through the rear vertical portion 120. The locator 184 is rigidly secured to vertical portion 120 by conventional means such as flat head screw 182 threadably received in the above-described bores. Locator device 184 also includes a cylindrical socket 185 centrally located and extending partially through the front portion of locator 184.

As depicted in FIGS. 2 and 4, enclosing the front and cylindrical surfaces of locator 184 is an adjuster assembly 186 comprising integrally connected and substantially cylindrical outer, intermediate and inner collars 188, 190 and 192, respectively. The collars 188, 190 and 192 are consecutively stepped in diameter, with outer collar 188 having the largest diameter. A cylindrical recess 189 is centrally formed through the outer collar 188 and partially through the intermediate collar 190. The recess 189 is of a diameter sufficient in size to encapsulate the locator 184. A threaded bore 191, concentric with recess 189 but of a smaller diameter, extends through inner collar 192, partially through intermediate collar 190, and opens into recess 189.

Threadably received in bore 191 and extending longitudinally through the central area of shell 123 is a partially threaded shaft 178. The shaft 178 is of a length so that it is threaded completely through the threaded bore 191 and protrudes into the recess 189 of adjuster assembly 186 and into the socket 185 of locator 184.

Figure 7:
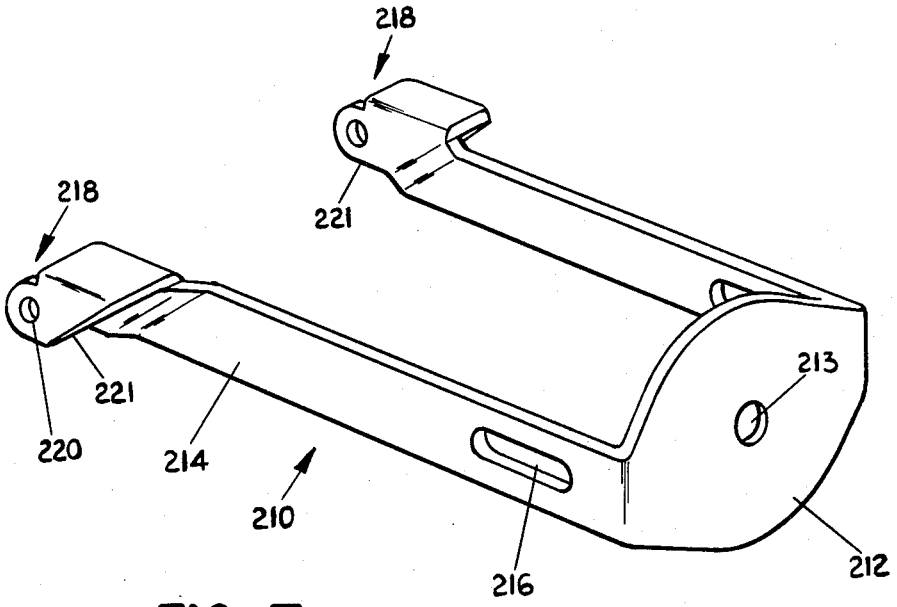
FIG. 7 is a perspective view of a spring yoke in accordance with the invention which can be utilized in the chair tilt mechanism depicted in FIG. 1.

Mounted within the front portion of shell 123 formed by support casting 110 is a spring yoke 210. For purposes of description, the yoke 210 is depicted in FIG. 7 apart from all other components of the tilt mechanism 100. The spring yoke 210 includes a front vertical portion 212 having a centrally located aperture 213. As depicted in FIG. 4, yoke 210 is mounted in shell 123 with the portion 212 facing towards the front vertical portion 122 of casting 110. The aperture 213 is positioned concentric with opening 179 and the shaft 178 is received through both aperture 213 and opening 179. The shaft 178 is also journalled into the adjustment knob 176. A bearing means, such as nylon bearing 180, secures the shaft 178 within aperture 213 so that shaft 178 is free to rotate therewithin when the adjustment knob 176 is manually turned.

As depicted in FIG. 7, the spring yoke 210 also includes a pair of side arms 214 integrally connected to and extending rearwardly from front vertical portion 212. Extending laterally through each of side arms 214 at the forward area thereof is a guide slot 216. Each side arm 214 terminates in an integrally connected yoke pivot bracket 218 angled outwardly and having bores 220 laterally extending through each of a pair of flanges 221.

The positioning of the above-described elements of yoke 210 relative to other elements of mechanism 100 is depicted in FIGS. 2, 4 and 5. The side arms 214 of yoke 210 extend rearwardly within shell 123 adjacent the side portions 124 of support casting 110. Each of the pivot brackets 218 with associated flanges 221 extends outwardly from and above a recessed area of the side portions 124. The brackets 218 are utilized to pivotably mount an associated one of the triangularly shaped rear links 160. As depicted in a cut-away view of FIG. 4, the flanges 221 of each of the brackets 218 are positioned on opposing sides of the rear link 160 so that a bore in link 160 is concentric with bores 220. A yoke pin 166 is received through bore 220 and secured by a means of a retainer ring 168. Thus, the rear link 160 is secured to spring yoke 210 in a manner so as to allow rotation of link 160 relative to an associated yoke pivot bracket 218.

As depicted in FIGS. 4 and 5, with respect to one of the side arms 214 of spring yoke 210, the yoke slot 216 is aligned with a bore 223 in a corresponding side portion 124 of casting 110. The relative alignment is such that the bore 223 is located near the rear of slot 216 when the front vertical portion 212 of yoke 210 is at its forwardmost biased position adjacent the front portion 122 of casting 110. A bearing means, such as nylon bearing 225, is snugly fitted within slot 216. A grooved guide pin 227 is compression fitted within bearing 225 and journalled into bore 223 of side portion 124. The relative sizes of slot 216, bore 223, bearing 225 and guide pin 227 are such that as yoke 210 and associated slots 216 are moved rearwardly, bearing 225 is free to slide within slot 216, but vertical movement of slot 216 relative to bore 223 is prohibited.

Referring again to FIGS. 4 and 5, the tilt mechanism 100 also includes an outer coiled spring 200 which extends longitudinally through shell 123. The front end of the spring 200 is compression fitted against the front vertical portion 212 of spring yoke 210. The opposing end of spring 200 is compression fitted against the outer collar 188 of adjuster assembly 186. The diameter of outer spring 200 relative to the diameter of intermediate collar 190 of assembly 186 provides a clamping of the rear coils of spring 200 around collar 190.

As depicted in FIG. 5, the mechanism 100 also includes an inner spring 202 which is of a smaller diameter and shorter length than outer spring 200. Like spring 200, the inner spring 202 extends longitudinally through shell 123. The rear end of inner spring 202 is compression fitted against a face of the intermediate collar 190 of adjuster assembly 186. In addition, the diameter of inner spring 202 relative to the diameter of inner collar 192 of adjuster assembly 186 provides a clamping of the rear coils of spring 202 around collar 192. The coils of the front opposing end of inner spring 202 are clamped around a small diameter section 193 of a cylindrical spring extender 194 having a bore therethrough which receives the threaded shaft 178. The spring extender 194 is snugly fitted to the shaft 178 but is free to move longitudinally therealong.

The operation of the chair tilt mechansim 100 will now be described with reference to the drawings. In the absence of externally applied tilting forces by an occupant of chair assembly 101, the chair tilt mechanism 100 will maintain a forward biased position, as depicted in FIGS. 1, 2, 4 and 5. It should be emphasized that vertically directed forces applied to the tilt mechanism 100 merely by the occupant's weight will not tend to move the mechanism 100 away from this position.

In the forward biased position, the front and rear links 150 and 160, respectively, are located as shown in FIG. 2. The chair seat 102, being rigidly connected to seat casting 130, is at a slight angle with its forward area above its rear area.

FIGS. 4 and 5 depict various components mounted within shell 123 when mechanism 100 is in the forward biased position. Specifically, in the absence of externally applied tilting forces, there will be no forces applied to spring yoke 210 through its pivot connections to rear links 160 at yoke pins 166. Accordingly, the only forces applied to yoke 210 are forward directed biasing forces maintained by the compression of outer spring 188. The front vertical portion 212 of yoke 210 will thus be forced against the front vertical portion 122 of support casting 110. The forward directed forces will also be translated through yoke 210 and its pivot connections to rear links 160 through pins 166 to maintain the links 160 in the forward biased position shown in FIG. 2. Correspondingly, forces thus applied to rear links 160 will be translated through its pivot connections to seat casting 130 through pins 162 and, in turn, to forward links 150 through the pivot connections formed by pins 152. The seat casting 130 and connected chair seat 102 are thus maintained in the initial forward biased position.

With the spring yoke 210 abutting the vertical front portion 122 of casting 110 as depicted in FIGS. 4 and 5, the outer spring 200 is maintained in a slightly compressed state with a length determined by the distance between outer collar 188 of adjuster assembly 186 and the front portion 212 of yoke 210. With the mechanism 100 initially biased in the position depicted in the drawings, there will be no compression forces applied to inner spring 202. That is, spring 202 will extend to its uncompressed length as depicted in FIG. 4 and the axial position of extender 194 along shaft 178 will be determined solely by this uncompressed length.

When the chair occupant desires to tilt the chair assembly 101 rearwardly, he will apply rearward "pushing" forces to the chair seat 102. An occupant can apply such forces directly to seat 102 through his legs by pushing his feet against the floor surface. However, it is also apparent that chair assembly 101 can include a back support (not depicted) connected by various conventional means to seat 102. The occupant can then apply tilting forces to chair assembly 101 by pushing rearwardly against such a back support.

The application of external tilting forces to mechanism 100 will tend to force the seat casting 130 rearward. This rearward force will cause the seat casting 130 to move to the left, as viewed in FIG. 2, and pivot at its forward end about the interconnections with forward links 150 through link pins 152. However, the forces applied to seat casting 130 will not translate merely to angular rotation forces about pins 152 through links 150, but will also impart forces on the elongated portions of links 150, thereby causing the links 150 to pivot about their lower stationary axis formed through interconnections to support casting 110 through shoulder screws 156. As viewed in FIG. 2, the forward link 150 depicted therein will thus rotate counterclockwise about shoulder screw 156. The pivot connections between seat casting 130, links 150 and support casting 110 as described above will thus cause the forward area of casting 130 to move rearwardly and downwardly.

Correspondingly, the external forces applied to casting 130 will cause the casting 130 to pivot relative to rear links 160 through link pins 162. In a manner similar to that described with respect to forward links 150, the casting 130 will impart forces to links 160 causing them to pivot about their lower stationary axis formed through their interconnections to support casting 110 through shoulder screws 164. As viewed in FIG. 2, the rear link 160 depicted therein will thus rotate counterclockwise about shoulder screw 164.

The pivoting of rear links 160 about the shoulder screws 164 will impart rearward directed forces to the spring yoke 210 through the interconnections formed by yoke pins 168 secured through the flanges 221 of pivot brackets 218. Accordingly, the spring yoke 210 will slide rearwardly along shaft 178, thereby compressing the outer spring 200. As the yoke 210 slides rearwardly, the guide pins 237 act as front stops and rear stops to prevent the mechanism from moving through other than its proscribed arc.

The compression of outer spring 200 will result in reaction or biasing forces from spring 200 opposing the movement of yoke 210. The reaction forces increase as the yoke 210 moves away from its forward biased position, thereby requiring the occupant to exert correspondingly increasing tilting forces to tilt the chair assembly 101 farther and farther away from equilibrium. If the exertion of tilting forces ceases, the biasing forces of spring 200 will push the yoke 210 forward and return all components of mechanism 100 to the forward biased position.

Figure 9:
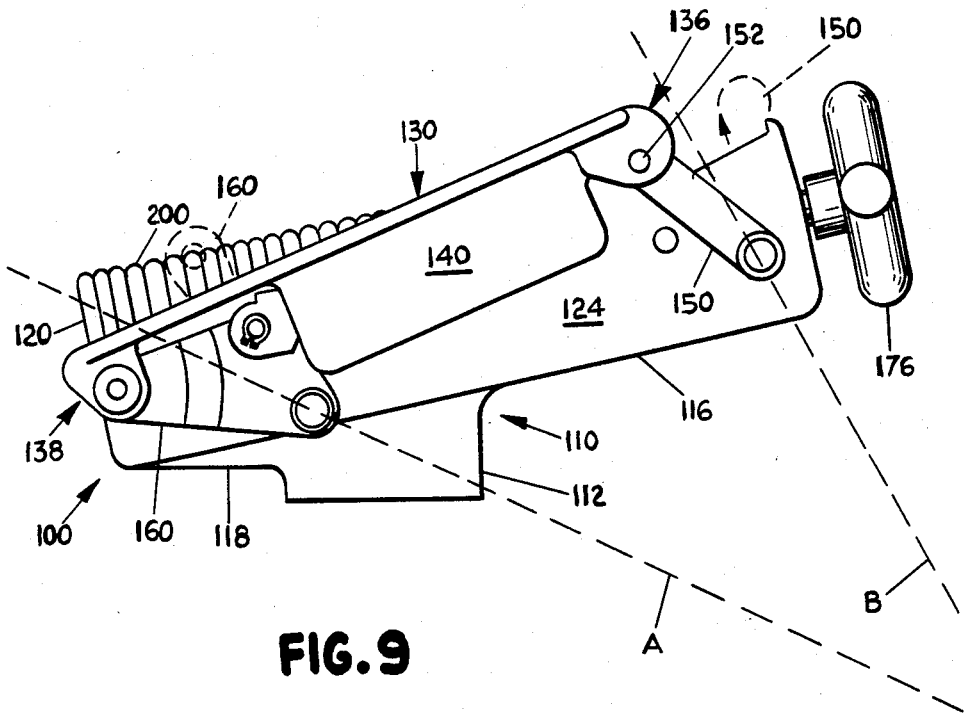
FIG. 9 is a side elevational view of the chair tilt mechanism depicted in FIG. 1 in a fully tilted position.
Figure 8:
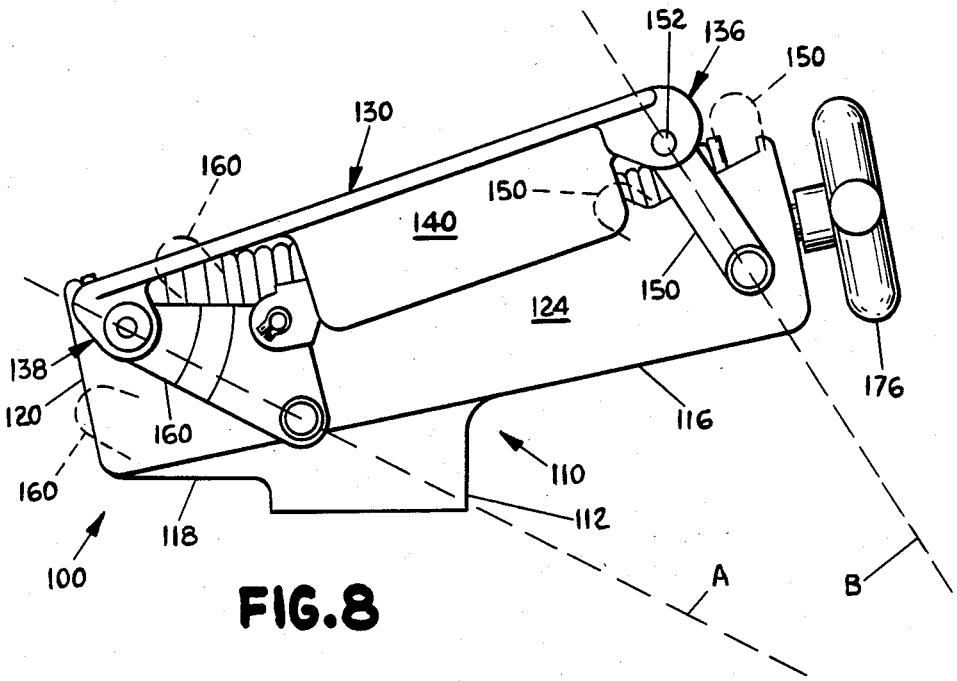
FIG. 8 is a side elevational view of the chair tilt mechanism depicted in FIG. 1 in an intermediate tilted position.

For purposes of understanding the tilting path of seat casting 130 and the functional movement of links 150, 160 in accordance with the invention, the position of various components of mechanism 100 when the chair assembly 101 has been tilted approximately half way between its initial forward biased position and a fully tilted position are depicted in FIG. 8. Similarly, FIG. 9 depicts the mechanism 100 with the seat casting 130 positioned in a fully tilted position. In addition, each drawing depicts in dotted line format the travel path of the pivot connections of links 150, 160 to seat casting 130.

The central axis of tilting rotation of seat casting 130 is best described by first defining the two planes A and B depicted in FIGS. 8 and 9. An upper pivot axis of the two rear links 160 relative to seat casting 130 can be defined by a line axially through the centers of the two colinear upper rear link pins 162. A stationary lower pivot axis of rear links 160 relative to support casting 100 can be defined by a line axially through the centers of the two shoulder screws 164. These upper and lower pivot axes will be parallel, and the plane A can be defined as including the lower pivot axis and bisecting the arc travelled by the upper pivot axis between the initial forward biased position and the fully tilted position.

Correspondingly, an upper pivot axis of the two forward links 150 relative to seat casting 130 can be defined by a line extending axially through the centers of the two colinear upper forward link pins 152. A stationary lower pivot axis of forward links 150 relative to support casting 110 can be defined by a line extending axially through the centers of the two shoulder screws 156. These pivot axes will also be parallel, and plane B can be defined as including the lower pivot axis and bisecting the arc travelled by the upper pivot axis between the initial forward biased position and the fully tilted position of forward links 150.

The four-bar linkage comprising links 150, 160 transposes the rotational axis of the seat casting 130 a distance away so as to provide a gradual tilting movement, as opposed to an abrupt angular rotation relative to a pivot at or near the casting 130. The transposed axis of rotation is defined by the line formed at the intersection of planes A and B. Although this axis is not specifically depicted in FIGS. 8 and 9, it is apparent from the relative relationship of planes A and B that the axis will be located near the chair occupant's ankles. Accordingly, the tilting motion will be more natural to the occupant than motion whereby the rotational axis is above the seat casting 130 or otherwise located a substantial distance away from the occupant's ankle position. The exact position of the rotational axis will be determined in part by the relative lengths and shapes of rear links 160 and forward links 150. The particular design of links 150, 160 to achieve a rotational axis near the occupant's ankle position will be apparent to the skilled designer having knowledge of the disclosure herein.

As described in the section entitled "Background Art", one problem with heretofore known seat tilt mechanisms is their general inability to compensate for chair occupants of a wide range of size and weight. That is, relatively heavier persons will tend to tilt a chair assembly to an uncomfortable angle unless the assembly includes high resistive or tensioning forces. Conversely, if such high tensioning forces must be overcome merely to move the assembly away from a forward biased position, relatively lighter weight persons will be uncomfortable. In accordance with the invention, however, the structural cooperation of springs 200, 202, extender 194 and yoke 210 provide a means for compensating for persons of widely differing weights.

Specifically, as the chair tilt mechanism 100 is tilted away from the forward biased position, the front vertical portion 212 of yoke 210 will compress outer spring 200, thereby causing the spring 200 to impart a reactive or biasing force against yoke 210 at a first force rate. When mechanism 100 tilts seat casting 130 through a sufficient first predetermined angle away from the forward biased position, the front vertical portion of yoke 210 will contact the forward end of spring extender 194. Further movement of seat casting 130, i.e. through a second angle beyond the first angle until the fully tilted position is achieved, will cause yoke 210 to compress not only outer spring 200 but also inner spring 202. The combined compression of both springs 200, 202 will impart a reactive or biasing force of a second force rate greater than the first force rate. The magnitude of the first predetermined angle will be dependent in part on the distance between the extender 194 and portion 212 of yoke 210 when the mechanism 100 is in the forward biased position.

As also discussed in the section entitled "Background Art", it is preferable that a chair tilting mechanism have means for adjusting the tension of the tilting mechanism, i.e. a means for adjusting the amount of externally applied tilting forces required to tilt a chair prescribed distances away from the forward biased position. It is also preferable to have a substantial range of such tension settings so as to accomodate both small and large individuals. For large individuals, the opposing forces exerted by the tilting mechanism should be relatively high. Conversely, a small individual is uncomfortable if he or she must overcome large opposing forces in order to tilt a chair to a desired position.

In accordance with the invention, the chair tilt mechanism 100 provides a means for adjusting the biasing or opposing reactive forces to externally applied tilting forces over a substantially wide range. Specifically, the occupant can adjust the compressed length of outer spring 200 when the spring 200 is in the initial forward biased position. As previously described, the rear end of the outer spring 200 abuts the surface of outer collar 188 of adjuster assembly 186. Correspondingly, the front end of spring 200 abuts the vertical front portion 212 of spring yoke 210. By rotating the adjustment knob 176, the occupant can adjust the threaded distance of shaft 178 within the adjuster assembly 186. For example, by rotating the adjustment knob 176 in a clockwise manner as viewed in FIG. 3, the shaft 178 will tend to thread inwardly within the adjuster assembly 186. However, with shaft 178 prevented from moving rearwardly by means of the abutment of adjustment knob 176 against the vertical front portion 122 of casting 110, and with the adjuster assembly 186 prevented from rotation by means of the exertion of forces against the assembly 186 through outer spring 200, clockwise rotation of knob 176 will result in the adjuster assembly 186 moving forward along the threaded portion of shaft 178. This movement will cause the distance between assembly 186 and the front portion 212 of spring yoke 210 to be decreased, thereby compressing spring 200. In this manner, the opposing forces exerted by spring 200 on yoke 210 can be adjustably increased or decreased for a given tilted position of the chair tilt mechanism 100. Advantageously, the adjustment arrangement heretofore described will not disturb the forward biased position. That is, the seat casting 130 will be maintained at one particular forward biased position regardless of the adjustment of the initial compressed length of outer spring 200.

It is also noted that adjustment by means of knob 176 will cause the distance between portion 212 of yoke 210 and the extender 194 to be selectively increased or decreased. Accordingly, for particularly heavy individuals, the portion 212 of yoke 210 can be made to contact extender 194 or even to compress inner spring 202 when the mechanism 100 is in the forward biased position. In such event, the occupant will be required to overcome biasing forces of both springs 200 and 202 througout movement of seat casting 130 from the forward biased to the fully tilted position.

Figure 10:
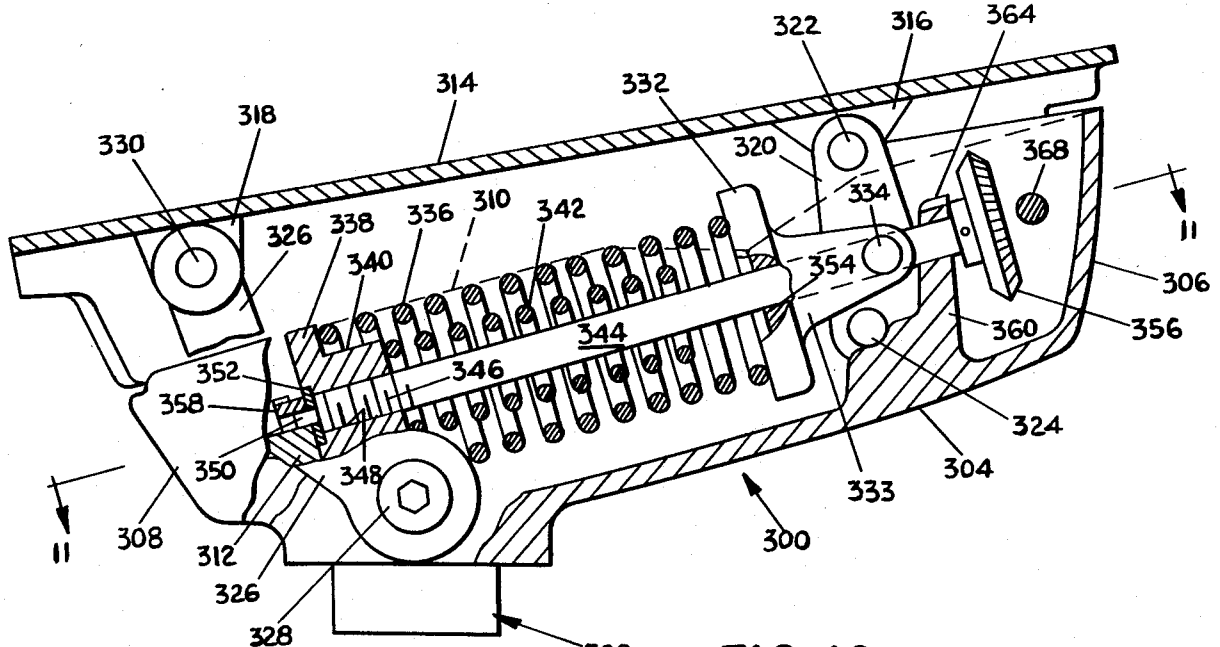
FIG. 10 is a side elevational view in section of a second embodiment of the invention.
Figure 11:
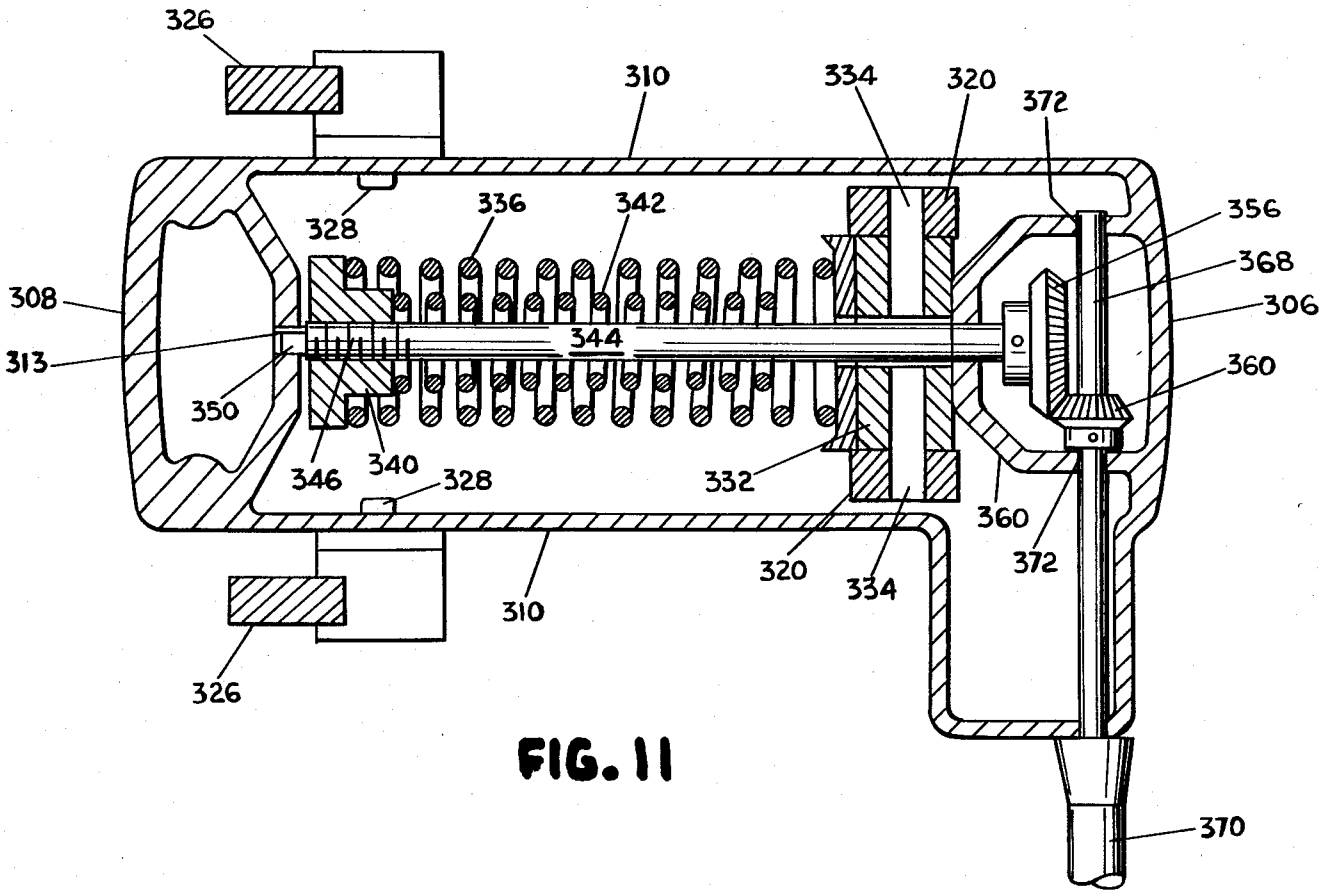
FIG. 11 is a sectional view along lines 11—11 of FIG. 10.

Referring now to FIGS. 10 and 11, there is shown a second embodiment of the invention which is a preferred embodiment according to the invention. The principle of the embodiment shown in FIGS. 10 and 11 is substantially the same as that shown in FIGS. 1–9 except that the compression takes place from the front links rather than the rear links. As shown in FIG. 10, a support casting 300 has a spindle housing 302, a bottom wall 304, a front wall 306, a back wall 308 and side walls 310. A stop member 312 is formed from a web within the back of the casting. A front web 360 is formed at the front portion of the casting and has a vertical slot 362 and bores 372. The stop member 312 has a slot 313 formed in a central portion thereof.

A seat casting 314 has a forward hinge bracket 316 and a rear hinge bracket 318. A forward link 320 is secured at one end to the seat casting 314 through a pin 322 and at the other end to the support casting 300 through a pin 324. A rear link 326 is secured at one end to the support casting 300 through a pin 328 and at the other end to the seat casting 314 through a pin 330.

A front spring retainer 332 has a pair of forwardly-projecting ears 333 through which it is pivotably coupled to the forward link 320 through a pair of pins 334. A large spring 336 is seated against a flat face of the front spring retainer 332 at one end and is seated against a rear spring retainer 338 at the other end. The rear spring retainer 338 has a forward annular projection 340. A small spring 342 is seated at one end against the forward projection 340 of the rear spring retainer 338 and projects forwardly to a point short of the front spring retainer 332.

An adjustment shaft 344 extends through the small spring 342 and has a threaded end 346 which is threaded into a tapped hole 348 of the rear spring retainer 338. The adjustment shaft 344 has a reduced-diameter journal end 350 which fits within the slot 313 of the stop member 312. A retainer plate 358 is secured to the stop member 312 through screws (not shown) to retain the journal end 350 of the adjustment shaft 344. Thrust washers 352 are positioned on the end of the adjustment shaft 344 and bear against the stop member 312 to firmly seat the shaft 344 thereagainst.

The forward end of the adjustment shaft 344 is journaled in the slot 362 in the front web 360. A retainer plate 364 is secured to the top of the front web 360 through screws (not shown) over the slot 362 to retain the adjustment shaft 344 within the slot 362. The adjustment shaft 344 is also slidably received within an opening 354 of the front spring retainer 332. A bevel gear 356 is secured to the forwardmost portion of the adjustment shaft 344.

A tension-adjusting shaft 368 having a handle 370 on the end thereof extends into the support casting 300 from the outside thereof and is journaled in the bores 372 of the front web 360. A bevel gear 366 is secured nonrotatably to the shaft 368 and meshes with the bevel gear 356.

In operation, as the seat casting 314 is pushed rearwardly with respect to the support casting 300, the seat casting 314 will pivot about a pivot axis near the ankle of the user. To this end, the links 326 will pivot about the pins 328 and the links 320 will pivot about the pins 324. As this pivot action takes place, the front links 320 drive the front spring retainer 332 rearwardly (or to the left as illustrated in FIG. 10), thereby compressing the large spring 336. If the seat casting 314 is rotated far enough, the front spring retainer 332 will eventually contact and begin compressing the small spring 342. When the small spring 342 is compressed, a much higher spring rate will be experienced.

The point at which the small spring 342 becomes activated can be adjusted by rotating the tension-adjusting shaft 368. Rotation of the shaft 368 will result in a corresponding rotation of the adjustment shaft 344 which, in turn, will cause the rear spring retainer 338 to move along the shaft 344 due to the threaded connection between shaft 344 and the rear spring retainer 338. As the rear spring retainer 338 is moved along the shaft 344 to the right as seen in FIG. 10, it compresses the large spring 336 and also moves the small spring 342 closer to the front spring retainer 332. Thus, the closer the small spring 342 is to the front spring retainer 332, the sooner the small spring 342 is effective during the tilting angle of the seat casting 314 with respect to the support casting 300. Movement of the rear spring retainer in an opposite direction will have an opposite effect on the point at which the small spring is effective.

It should be noted that many of the particular mechanical assemblies and interconnection arrangements described herein are not meant to be an exhaustive enumeration of the particular structures which can be utilized with a chair tilt mechanism in accordance with the invention. Accordingly, it will be apparent to those skilled in the pertinent art that modifications and variations of the above-described illustrative embodiments of the invention can be effected without departing from the spirit and scope of the novel concepts of the invention.

The embodiments of the invention in which an exclusive property or privilege is claimed are defined as follows:

1. A chair tilt mechanism comprising:

lower support means adapted to be mounted to a chair base;

a seat support means for mounting a chair seat;

forward linkage means pivotably connected at one end to a forward portion of the seat support means and at another end to a forward portion of the lower support means for supporting the seat support means above the lower support means;

rear linkage means located rearward of the forward linkage means and pivotably connected at one end to a rear portion of the seat support means and at another end to a rear portion of the lower support means for supporting the seat support means above the lower support means; and the spacing between the forward and rear linkage means, the position of the front and rear linkage means on the lower support means and the seat support means and the size of the forward and rear linkage means are all selected so that the chair seat tilts about a pivot axis of rotation near the ankle position of a chair occupant.

2. A chair tilt mechanism in accordance with claim 1 and further comprising:

biasing means mounted to the lower support means for biasing the seat support means to a forward position with respect to the lower support means; and said biasing means having a first force rate when the seat support means tilts through a first angle relative to the lower support means and a second force rate greater than the first force rate when the seat support means moves through a second angle subsequent to the first angle.

3. A chair tilt mechanism in accordance with claim 2 and further comprising means for adjusting the extent of the first angle.

4. A chair tilt mechanism in accordance with claim 2 wherein the biasing means comprises:

first compressible means mounted to the lower support means and responsive to the movement of one of the rear and forward linkage means for generating biasing force at the first force rate while the seat support means tilts through the first angle, and for generating a portion of biasing force at the second force rate while the seat support means moves through the second angle;

second compressible means mounted to the lower support means and responsive to movement of the seat support means only beyond the first angle for generating a portion of the biasing force; and translation means connected to said one of the rear and forward linkage means for compressing the first compressible means during movement of the seat support means through the first angle, and for compressing the second compressible means during movement of the seat support means through the second angle.

5. A chair tile mechanism in accordance with claim 4 wherein the translation means is pivotably connected to said one of the rear and forward linkage means, and the tilt mechanism further comprises means for slidably mounting the translation means to the lower support means so as to allow the translation means to slide rearwardly in response to movement of said one of the rear and forward linkage means away from the forward biased position, thereby compressing the first and second compressible means.

6. A chair tilt mechanism in accordance with claim 5 wherein the translation means comprises a yoke pivotably connected to said one of the rear and forward linkage means and a forward vertical portion mounted to the means for slidably mounting the translation means.

7. A chair tilt mechanism in accordance with claim 6 wherein the means for slidably mounting the translation means comprises a shaft longitudinally extending within the lower support means.

8. A chair tilt mechanism in accordance with claim 7 wherein the first compressible means is mounted longitudinally along the shaft and abuts a rear face of the forward vertical portion of the yoke.

9. A chair tilt mechanism in accordance with claim 7 wherein the first compressible means comprises a coiled outer spring mounted around the shaft and having a forward end abutting a rear face of the forward vertical portion of the yoke so that rearward movement of the vertical front portion of the yoke compresses the coiled outer spring, thereby generating at least in part the biasing force.

10. A chair tilt mechanism in accordance with claim 7 wherein the second compressible means is mounted longitudinally along the shaft and spaced a predetermined axial distance from the forward vertical portion of the yoke when the seat support means is in the forward biased position.

11. A chair tilt mechanism in accordance with claim 10 wherein the magnitude of the first angle is at least in part a function of the magnitude of the predetermined axial distance.

12. A chair tilt mechanism in accordance with claim 10 wherein the vertical front portion of the yoke is adapted to slide rearwardly on the shaft upon application of externally applied tilting forces, and initially contact the second compressible means when the seat support means attains the extent of the first angle.

13. A chair tilt mechanism in accordance with claim 10 wherein the second compressible means comprises a coiled inner spring and a spring extender, each mounted coaxially along the shaft, so that movement of the seat support means only through the second angle causes the forward vertical portion of the yoke to compress the coiled inner spring, thereby generating at least in part the biasing force when the seat support means is tilted beyond the first angle.

14. A chair tilt mechanism in accordance with claim 4 and further comprising means for adjusting the extent of the first angle.

15. A chair tilt mechanism in accordance with claim 14 wherein the first compressible means comprises a forward end and a rear end, and the adjustment means comprises:

compressing means in contact with the rear end of the first resilient means for compressing the linear length of the first compressible means; and means for mounting the compressing means to the lower support means so as to allow the compressing means to move forwardly in response to manual adjustment of the adjustment means, thereby compressing the first compressible means.

16. A chair tilt mechanism in accordance with claim 15 wherein the compressing means is also in contact with a rear end of the second compressible means and forward movement of the compressing means decreases the distance between the second compressible means and the forward end of the first compressible means.

17. A chair tilt mechanism in accordance with claim 15 wherein:

the first compressible means comprises a coiled outer spring having a forward end and a rear end and mounted longitudinally to the lower support means;

the means for mounting the compressing means comprises a thread on a terminating end of a shaft axially extending through the outer spring;

the compressing means abuts the rear end of the outer coiled spring and is threadably received on the shaft; and rotation of the shaft in one direction causes compression of the outer spring by maintaining the forward end of the spring in a stationary position while moving forwardly the rear end of the outer spring.

18. A chair tilt mechanism in accordance with claim 1 wherein the rear linkage means comprises a pair of parallel links mounted on opposing lateral sides of the seat support means and the forward linkage means comprises a pair of parallel elongated links mounted on opposing lateral sides of the seat support means.

19. A chair tilt mechanism in accordance with claim 18 and further comprising:

compressible means mounted to the lower support means and responsive to movement of the forward and rear links away from a forward biased equilibrium position for generating an opposing force having a direction tending to return the forward and rear links to the forward biased position; and translation means pivotably connected to each of one of the forward and rear links for compressing the compressible means in response to movement of the forward and rear links away from the forward biased position.

20. A chair tilt mechanism in accordance with claim 19 wherein:

the compressible means comprises a coiled spring mounted longitudinally to the lower support means;

the translation means comprises a spring yoke slidably mounted within the lower support means and having a forward vertical portion abutting a forward end of the coiled spring, one side of the translation means being pivotably connected to a different one of the forward or rear links; and rotation of the forward and rear links away from the forward biased position causes the forward vertical portion of the spring yoke to slide rearwardly, thereby compressing the coiled spring.

* * * * *